US012122622B2

(12) United States Patent
Cuff et al.

(10) Patent No.: US 12,122,622 B2
(45) Date of Patent: Oct. 22, 2024

(54) HIGH BACK COIL CAR DESIGNED TO FACILITATE AUTOMATIC BANDING ON THE COIL CAR

(71) Applicant: Butech, Inc., Salem, OH (US)

(72) Inventors: Jason Cuff, Columbiana, OH (US); Nathaniel Gamble, North Jackson, OH (US); Ryan Mercer, Columbiana, OH (US); Benjamin Greenawalt, Salem, OH (US)

(73) Assignee: Butech, Inc., Salem, OH (US)

( * ) Notice: Subject to any disclaimer, the term of this patent is extended or adjusted under 35 U.S.C. 154(b) by 954 days.

(21) Appl. No.: 17/149,471

(22) Filed: Jan. 14, 2021

(65) Prior Publication Data

US 2021/0221635 A1 Jul. 22, 2021

Related U.S. Application Data

(60) Provisional application No. 62/961,982, filed on Jan. 16, 2020.

(51) Int. Cl.

| | |
|---|---|
| ***B65H 19/29*** | (2006.01) |
| ***B65B 13/04*** | (2006.01) |
| ***B65B 27/06*** | (2006.01) |
| ***B65H 18/26*** | (2006.01) |
| ***B65H 18/28*** | (2006.01) |
| ***B65H 19/30*** | (2006.01) |

(52) U.S. Cl.

CPC ..... *B65H 19/29* (2013.01); *B65B 13/04* (2013.01); *B65B 27/06* (2013.01); *B65H 18/26* (2013.01); *B65H 2701/173* (2013.01)

(58) Field of Classification Search

CPC ..... B65B 13/04; B65B 13/06; B65B 27/06; B65H 19/29; B65H 18/26; B65H 2701/173; B65H 2301/414446; B65H 18/28; B65H 19/30

See application file for complete search history.

(56) References Cited

U.S. PATENT DOCUMENTS 3,329,083 A * 7/1967 Bellmann ..... B21C 47/24 53/529

FOREIGN PATENT DOCUMENTS

| | | | |
|---|---|---|---|
| KR | 100396077 B1 | * | 8/2003 |
| KR | 100752315 B1 | * | 8/2007 |
| KR | 20180021304 A | * | 8/2018 |

OTHER PUBLICATIONS

English translate (KR100752315B1), Feb. 13, 2024.*
English translate (KR100396077B1), Feb. 13, 2024.*
English translate (KR20180021304A), Feb. 13, 2024.*

* cited by examiner

*Primary Examiner* — Mohammed S. Alawadi
(74) *Attorney, Agent, or Firm* — Lippes Mathias LLP

(57) ABSTRACT

A strip process line has a high back coil car for automatically banding coil of metal strip on the coil car. The process line runs while banding occurs on the coil car. The coil car includes an outer frame, and coil receiving saddle with a pair of blocker rolls or a "V" saddle, and a hold down arm and a plurality of strap guide channels. By the high back car being docked with an automatic loading station, the process line can run while the banding takes place on the coil car, and keeps the operator safely away from the coil car until the banding is completed.

26 Claims, 9 Drawing Sheets

HIGH BACK COIL CAR DESIGNED TO FACILITATE AUTOMATIC BANDING ON THE COIL CAR

CLAIM OF PRIORITY

This application claims priority from Provisional Application Ser. No. 62/961,982 filed on Jan. 16, 2020, the entirety of which is hereby incorporated by reference herein.

BACKGROUND OF THE DISCLOSURE

In the metals industry, lengths of metal (both ferrous and non-ferrous) are typically handled as coils. Coils provide a compact shape for transport. A coil to coil type of process may have a coil car at the entry end of the process as well as a coil car at the exit end of the process. Examples of coil to coil process lines include: galvanizing lines, paint lines, pickling lines, inspection lines, etc.

As the metal strip is being processed it is typically rewound into a coil by a machine known in the industry as a recoiler or tension reel. For purposes of this disclosure, the term recoiler will be used. The strip is coiled with a tension force applied during the coiling process. The winding tension keeps the coil rigid so that it can be transported without altering its shape.

Because of the winding tension, when the coiling process comes to an end, the tail of the strip needs to be restrained to prevent the coil from clock springing. Typically, a clamp or hold down arm mounted to the recoiler pinches the tail of the strip against the body (outside diameter) of the coil thus preventing loss of tension in the coil.

For the coil to be removed from the recoiler, the outer diameter (OD) of the coil needs to be banded or the tail of the strip can be welded to the outer wrap of the coil. OD bands (also known as straps) are applied to the OD of the coil cinching the OD. Several bands can be applied to the same coil dependent on coil width, strip thickness, material strength and winding tension.

In some process lines, the bands are applied while the coil is still mounted on the recoiler. A problem with this approach is this results in a loss of production, until the coil is banded and removed from the recoiler.

To minimize this loss of production, coils can be banded after removal from the recoiler. The vehicle for transporting the coil from the recoiler is known in the industry as a coil car.

Coil cars are available in a variety of styles. The style of coil car addressed in this disclosure is known as a high back or 'L' type coil car. This type of coil car does not require a pit. All of the coil car features are above grade. The high back portion of the coil car serves as a rigid mast for the outer car to elevated relative to the inner frame. The outer frame serves as the cradle on which the coil rests. The cradle could be a simple V-shaped trough or saddle or it could have a pair of rolls (i.e., blocker rolls) between which the coil sits.

In some cases, a coil can be loaded with the strip tail trapped between the saddle and the body of the coil. The weight of the coil against the tail prevents the coil from clock springing; while the coil is transported to a banding station and bands can be applied by an operator or automatically.

With ever higher tensile strength of the process strip, significantly higher winding tensions are required. This results in higher clock springing energy stored in the coil. Trapping the strip tail and holding it with the weight of the coil becomes less practical and more dangerous.

In those instances, it is necessary to restrain the coil mechanically. To avoid loss of production requires the coil to be safely removed from the recoiler and banded later. This requires the coil car to have a hold down arm that restrains the coil allowing it to be removed. The hold down arm is engaged the entire time until the coil is properly banded.

However, none of the existing technology includes a design of a high back car that can dock with an automatic banding station, thus allowing the process line to run while the banding takes place on the coil car, and keeps the operator safely away from the coil car until the banding is completed.

Automatic banding equipment exists in today's industry, but based on the complexity, there is no docking of a high back coil car to an automatic banding station. Therefore, what is needed is a high back coil car design that has the ability to restrain and receive a coil wound with high tension and subsequently dock with an automatic banding station.

Accordingly, there is a need for a high back coil car to facilitate automatic banding of coil on the coil car which overcomes the above mentioned deficiencies and others while providing better overall results.

SUMMARY OF THE DISCLOSURE

In accordance with a preferred embodiment of the disclosure, a strip process line has a high back coil car for automatically banding coil on the coil car. The process line runs while banding occurs on the coil car. The coil car has an elevating outer frame, a coil receiving saddle, and a hold down arm and a plurality of coil banding strap guide channels, as well as other ancillary components.

In accordance with another aspect of the disclosure, a method of automatically banding coil of metal strip, comprises: providing a high back coil car at an end of a process line for automatically banding coil of metal strip on the coil car, wherein the process line runs while banding occurs on the coil car; and wherein the high back coil car has an outer frame, a coil receiving saddle and a hold down arm and a plurality of strap guide channels.

In accordance with another aspect of the disclosure, the high back coil car is supported on wheels that ride on rails that are embedded in the floor. A hydraulic cylinder raises the outer frame carrying the coil receiving saddle.

In accordance with another aspect of the disclosure, blocker rolls or "V" saddles can be provided which can be grooved to receive strapping guide channels which curve upwards along the coil car back, and then extend above the coil car back.

In accordance with another aspect of the disclosure, the strip is processed and rewound as a coil onto the mandrel of a recoiler. If the strip has high tensile properties, the strip is wound at high tension. When the strip tails out of the process line, the outer wrap of coil is pinched by a hold down arm which is mounted on the recoiler.

In accordance with another aspect of the disclosure, the high back coil car is traversed towards coil which is on the mandrel of the recoiler. At this time, the coil car outer frame is in its fully lowered position. Once in position under the coil, the coil car outer frame is then raised by a hydraulic cylinder until the outer diameter of the coil is tight against the blocker rolls.

In accordance with another aspect of the disclosure, the coil car hold down arm is lowered and positioned by hydraulic cylinders until the coil car hold down arm pad is fight against the outer diameter of coil. The recoiler hold down arm is raised, and the coil is removed from the mandrel, then the coil car outer frame is lowered all the way down. Since the coil car hold down arm is mounted to the coil car outer frame, the coil car hold down arm stays tight against coil while the outer frame is lowered.

In accordance with another aspect of the disclosure, the high back coil car now enters an automatic sequence that is initiated by the operator. The coil car moves away from the recoiler while advancing towards the banding station. The coil car traverses via an electric motor with an encoder that is used to position the coil car relative to a banding station guide arm.

According to another aspect of the disclosure, dependent on the width of coil, the coil car will position itself such that a coil car strapping guide channel is positioned in perfect alignment with the banding slot guide mounted on the banding strap guide arm. The coil car stays in this position until a banding strap has been applied to the outer diameter of the coil. To accomplish this, a banding strap is fed by a banding head upwards and within the banding strap guide arm, then down towards and within the coil car strapping guide channel, which extends down the coil car blocker rolls. The leading end of the banding strap continues past the coil car saddle, towards the banding head which is then lowered against the outside diameter of coil. The banding head then pulls the strap tight. The strap then comes out of the various strapping guide channels and becomes tight and is cinched against the outer diameter of the coil. The banding station then clinches or welds the strap end to the body of the strap. The banding head then moves away from the coil.

In accordance with another aspect of the disclosure, the coil car is advanced (i.e., indexed) over until the next coil car strapping guide channel is positioned in complete alignment with the banding slot guide mounted on the banding strap guide arm. The banding sequence commences again and is completed as described above. This operation repeats itself as necessary with coil car indexing as necessary until the full complement of banding straps have been applied to the coil. The number of straps applied and the number of automatic indexing cycles for coil car, is dependent on the width of the coil. In this embodiment, a maximum of six banding straps can be applied. Other numbers of straps and cycles are contemplated by the disclosure.

Still other aspects of the disclosure will become apparent upon a reading and understanding of the following detailed description.

DETAILED DESCRIPTION OF THE DISCLOSURE

Figure 1:
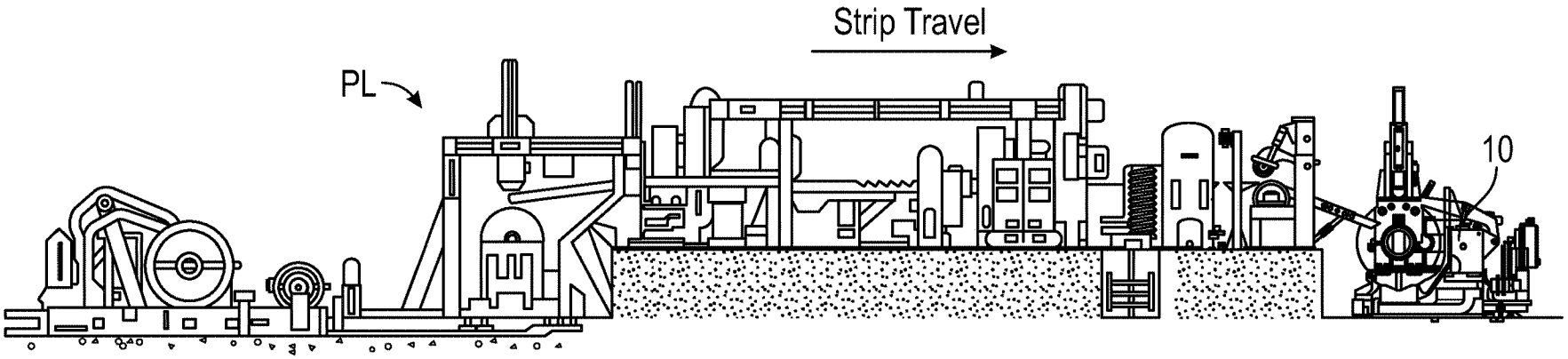
FIG. 1 is a side elevational view of a process line wherein the strip travels and is rewound as a coil at the exit end of the process.

As discussed above, none of the existing technology includes a high back coil car that can dock with an automatic banding station, thus allowing the process line to run while the banding takes place on the coil car, and keeps the operator safely away from the coil until the banding is done. Referring now to FIG. 1, a typical process line (PL) is shown showing strip travel wherein the strip is rewound as a coil at the exit end of the process. A coil car 10 is shown at the exit of the process line.

A high back coil car to facilitate automatic banding on the coil car in accordance with a preferred embodiment of the disclosure is discussed below and is shown in FIGS. 2, 3, 4, 4A, 5, 6, 6A and 7.

Figure 3:
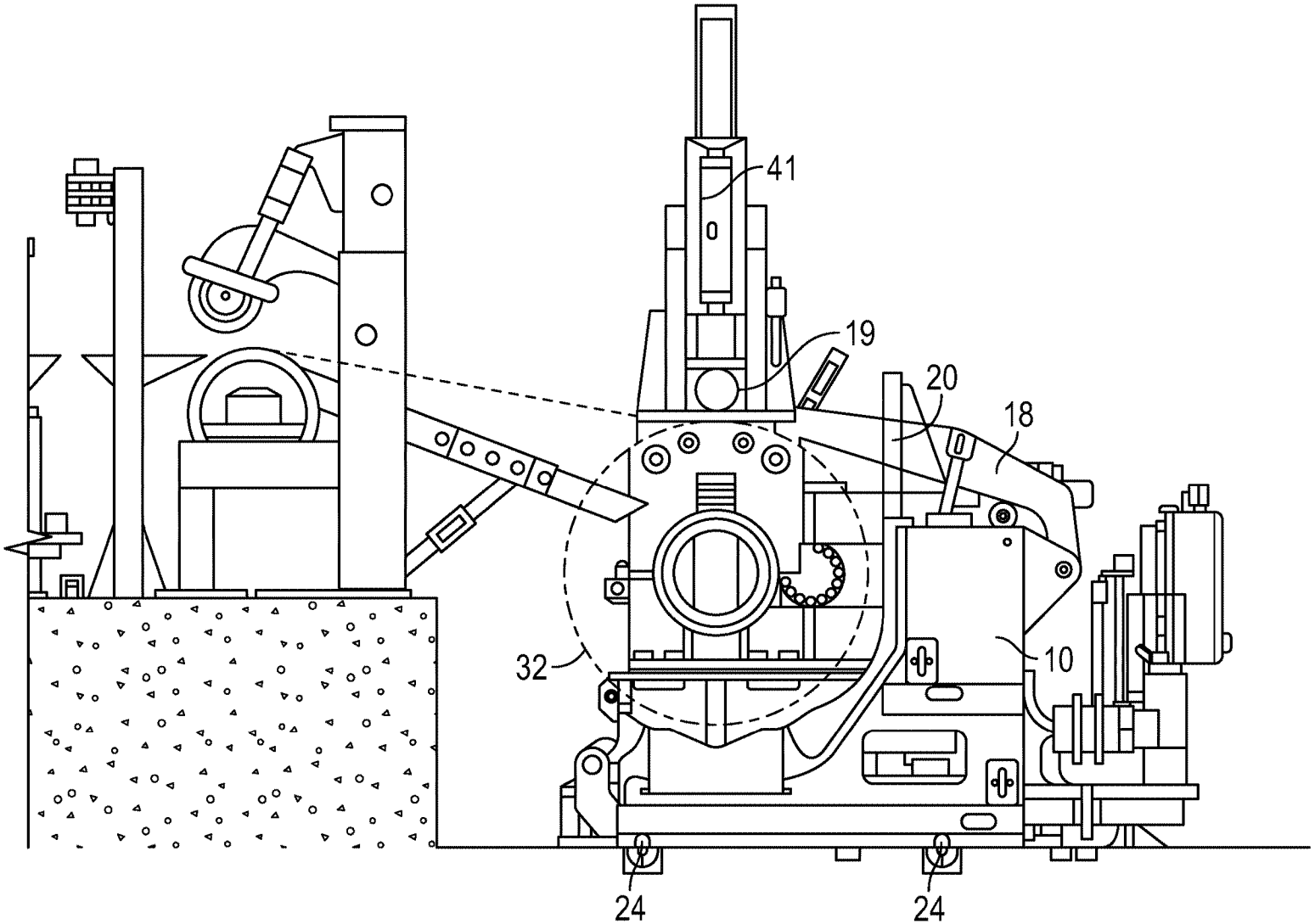
FIG. 3 is a side elevational view of the high back coil car and the wound coil at the exit of the process line in accordance with the preferred embodiment of the disclosure.
Figure 4:
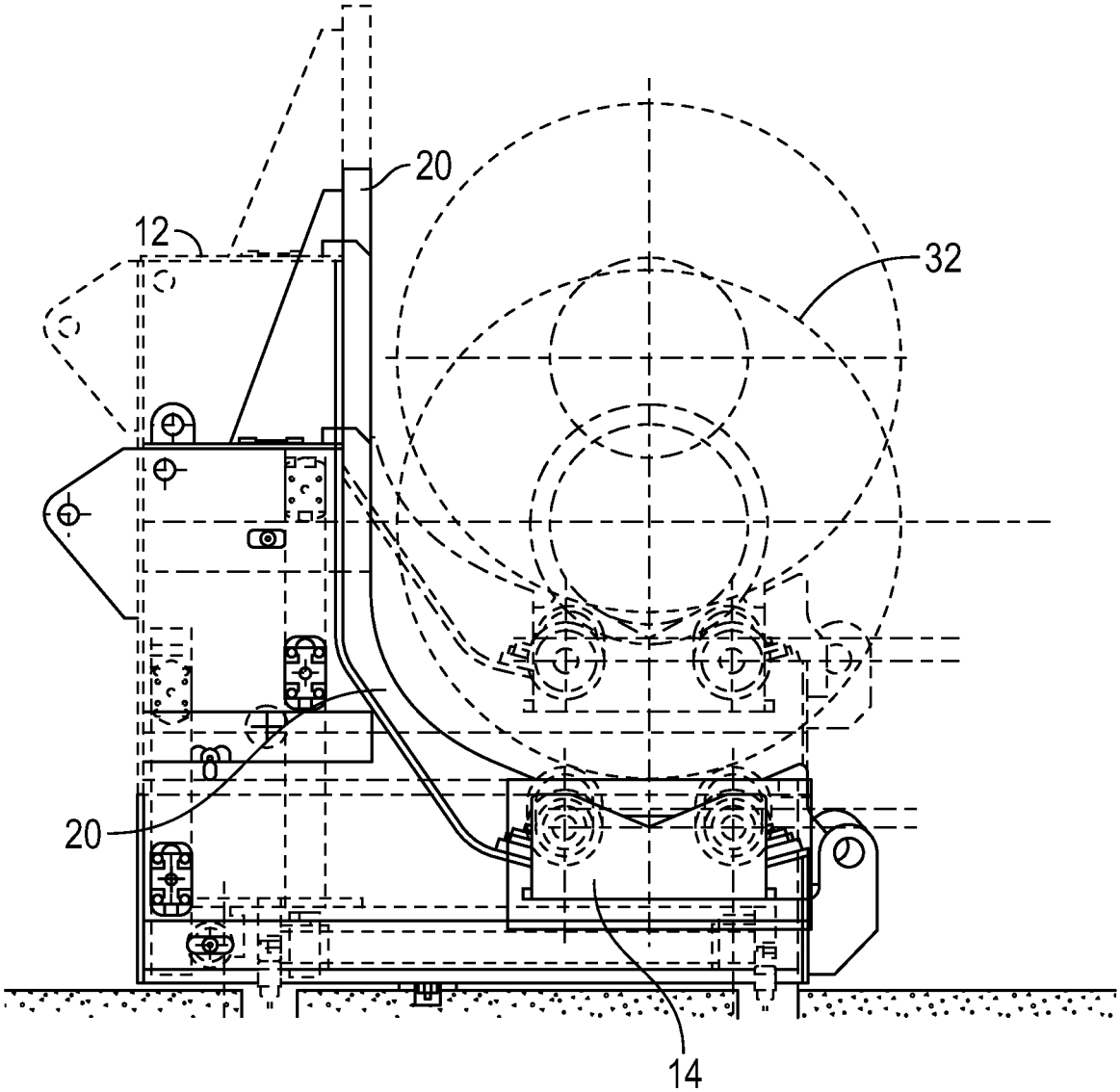
FIG. 4 is a side elevational view of the high back coil car shown in a lowered and elevated state in accordance with the disclosure.
Figure 4A:
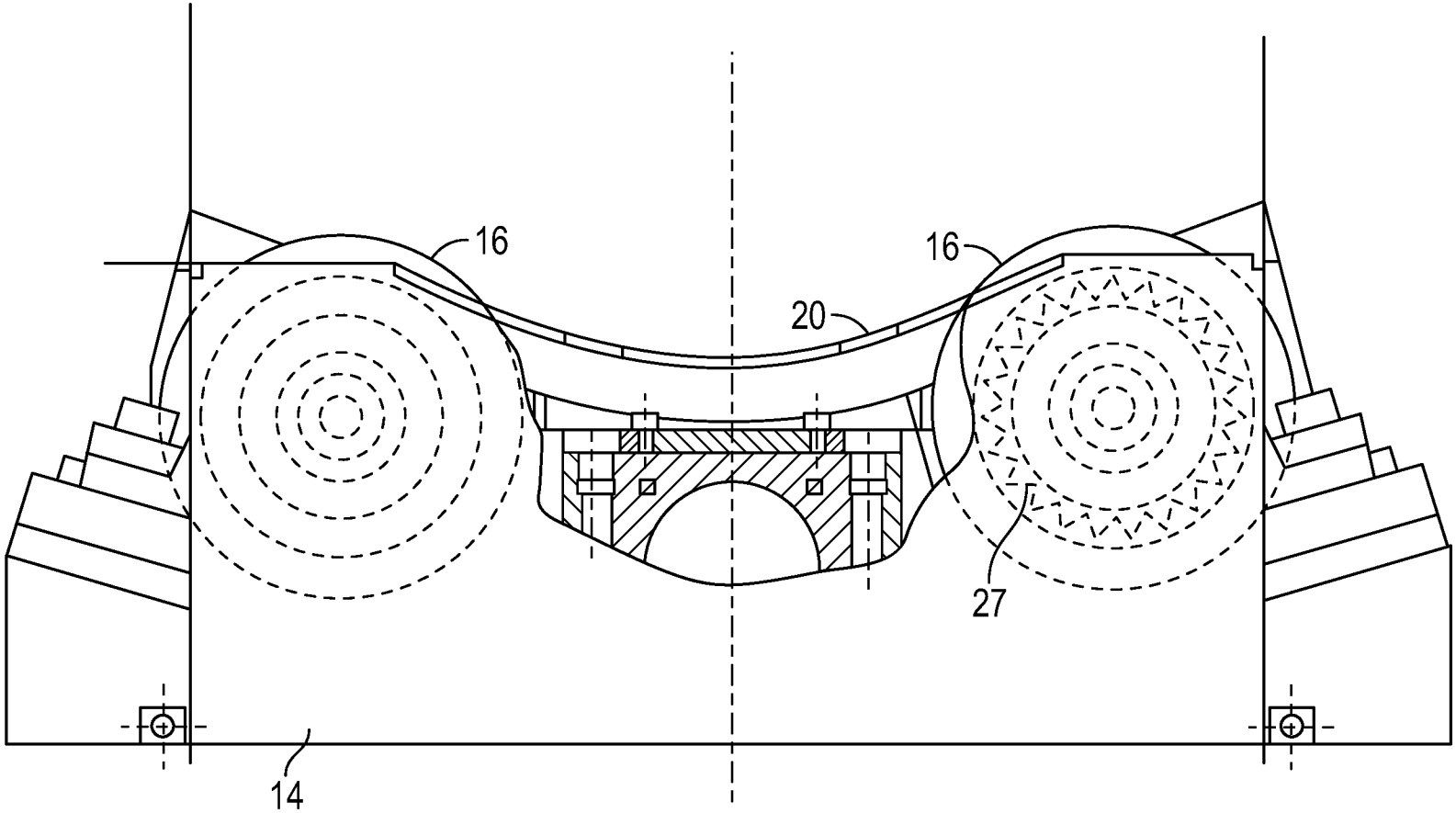
FIG. 4*a* is an enlarged elevated view of the coil saddle and driven blocker rolls in accordance with another embodiment of the disclosure.

Specifically, referring to FIGS. 3, 4 and 4*a*, a high back coil car 10 includes an elevating outer frame 12, a coil receiving saddle 14 which can be provided with a pair of driven blocker rolls 16, a coil hold down arm 18, a plurality of coil banding strap guide channels 20, and other ancillary components that will be further described in this disclosure. A "V" saddle could be used as an alternative to the blocker rolls in accordance with another embodiment of the disclosure.

Figure 5:
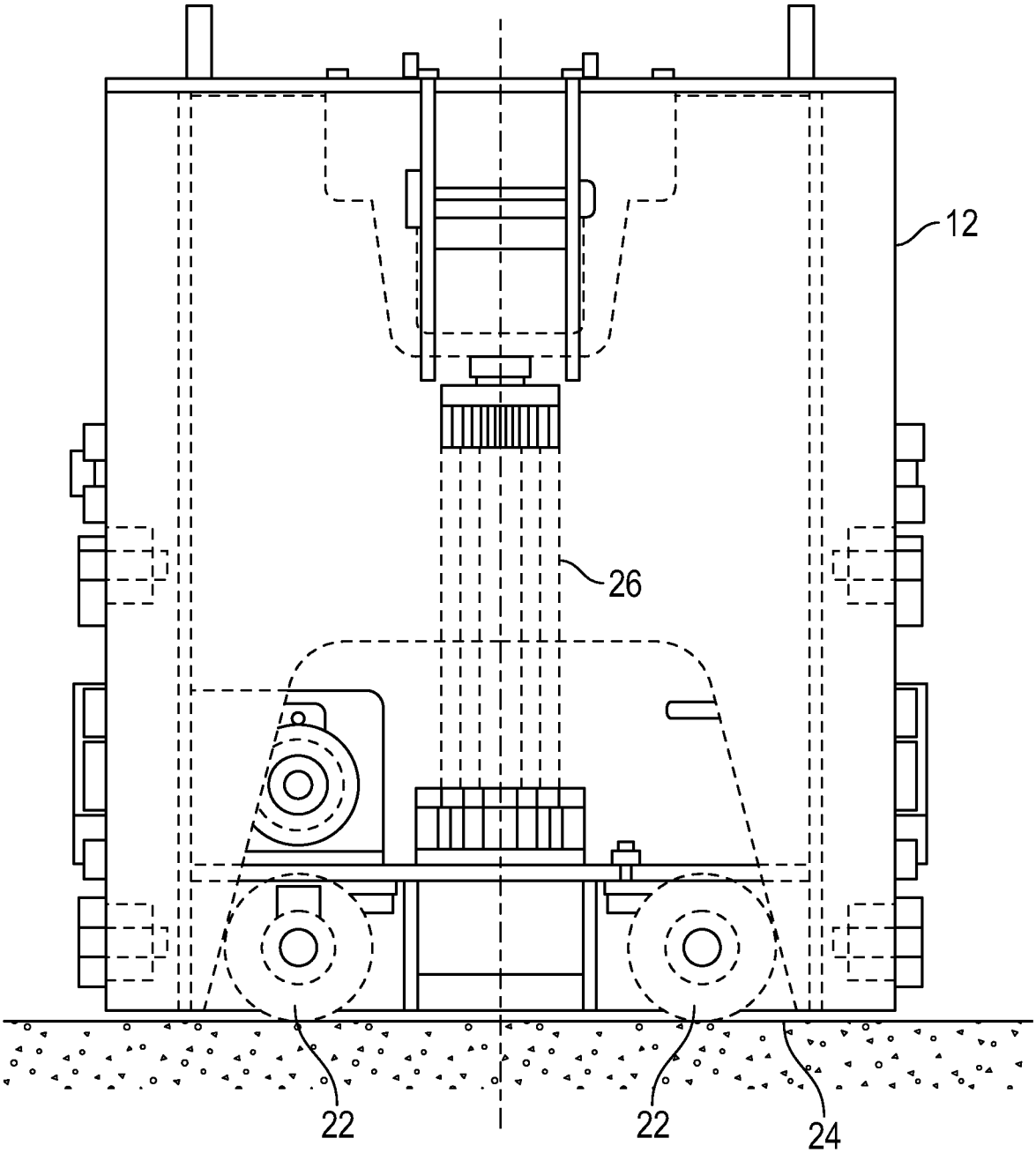
FIG. 5 is a rear elevational view of the high back coil car in accordance with another embodiment of the disclosure.

Referring now to FIG. 5, the high back coil car is supported on wheels 22 that ride on rails 24 that are embedded in the floor.

A hydraulic cylinder 26 is used to raise the outer frame 12 carrying the coil saddle 14 and the blocker rolls 16 (see FIG. 4A). The blocker rolls 16 are preferably driven by a chain and sprocket 27 arrangement.

Figure 6:
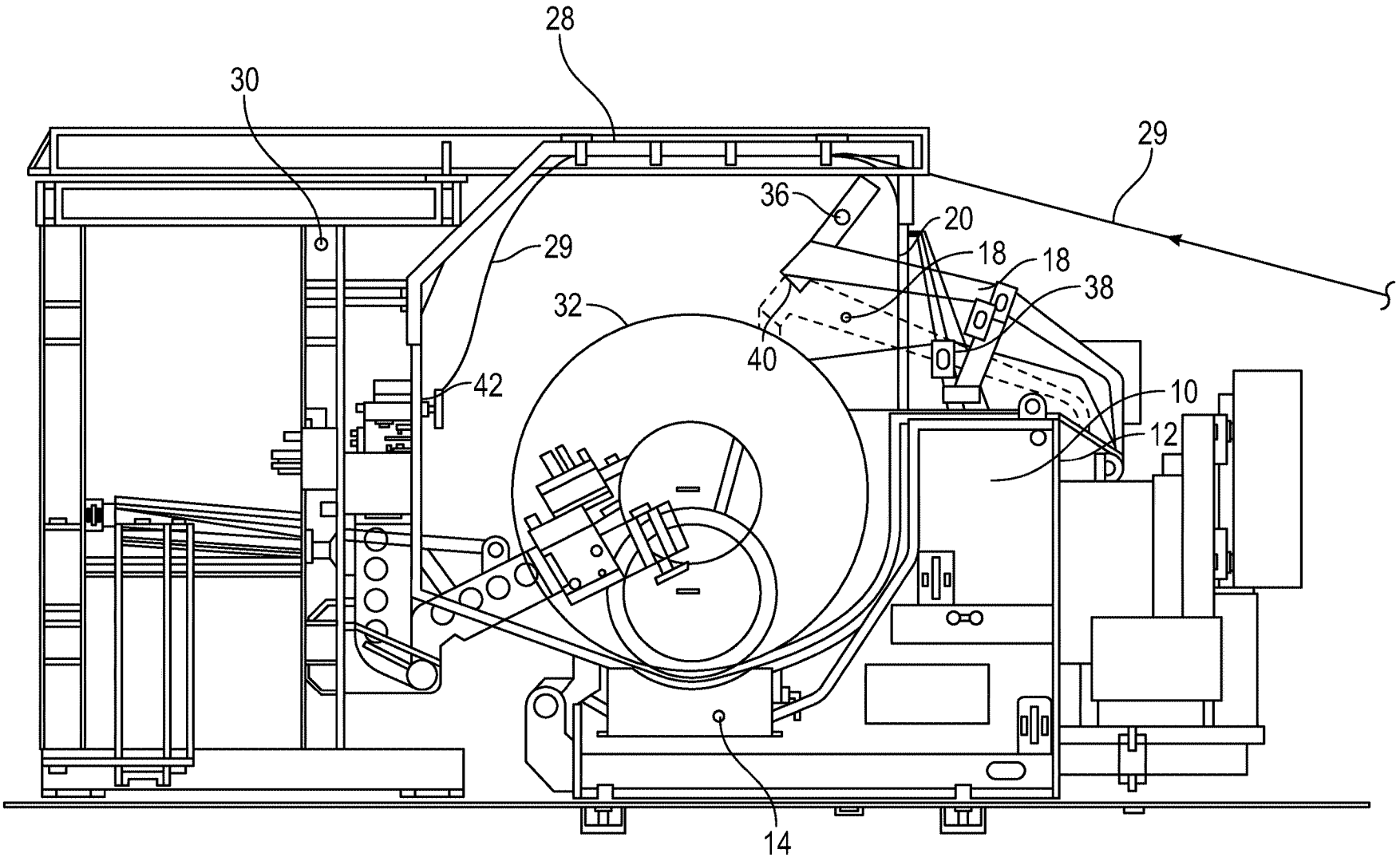
FIG. 6 is a side elevational view of the high back coil car docked at the banding station in accordance with another embodiment of the disclosure.
Figure 6A:
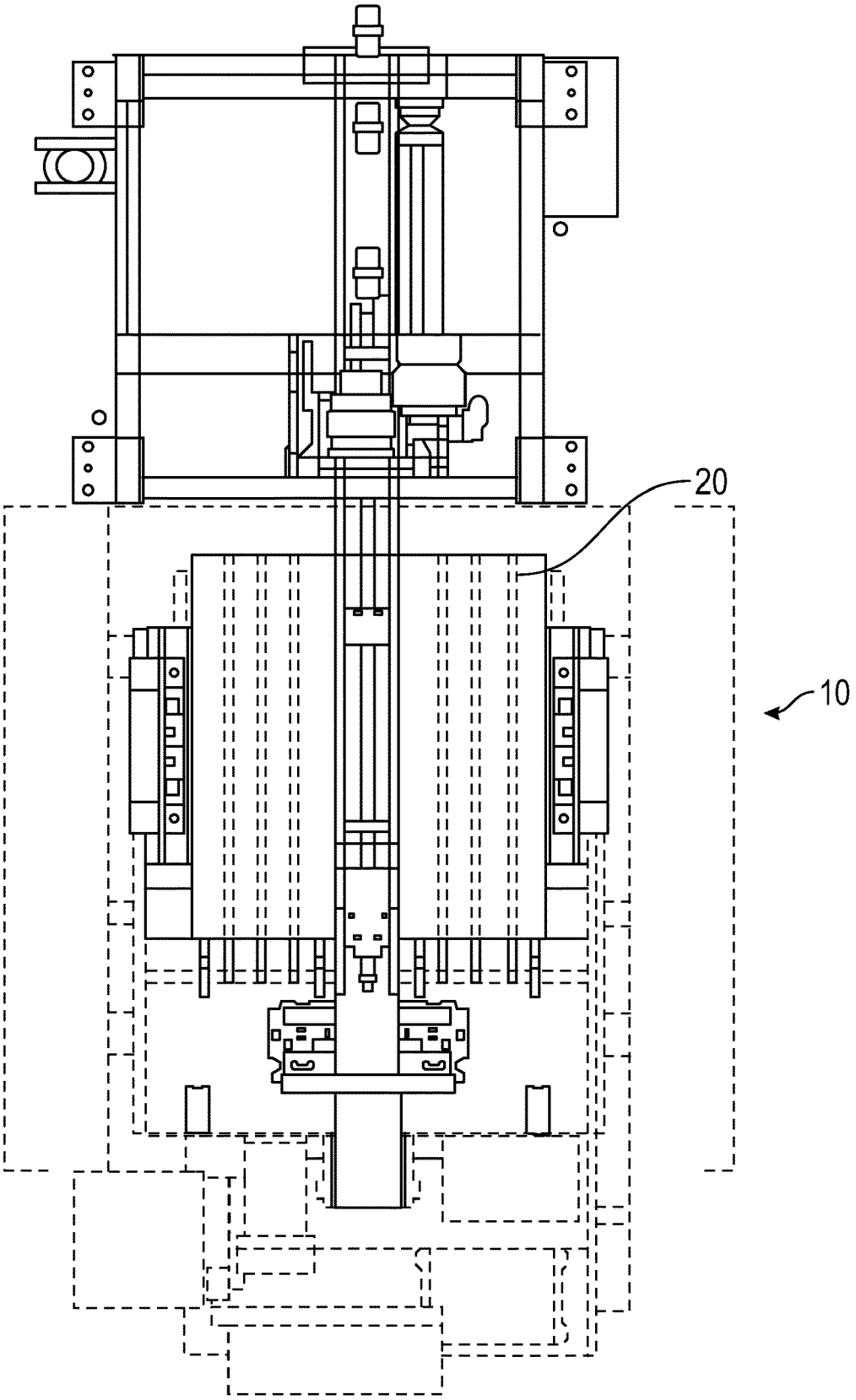
FIG. 6*a* is a top plan view of the high back coil car docked at the banding station in accordance with another embodiment of the disclosure.
Figure 7:
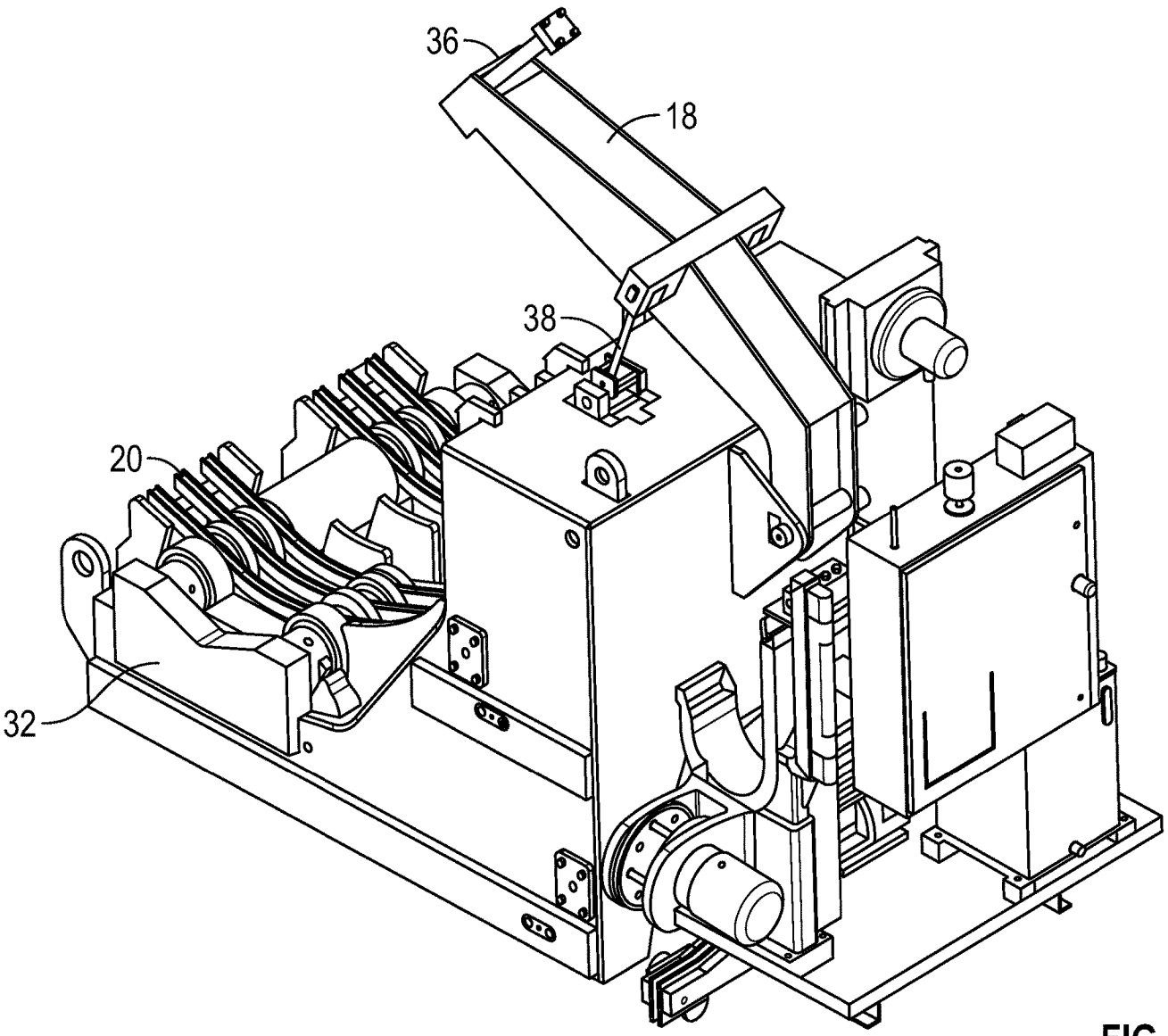
FIG. 7 is a perspective view of the high back coil car in accordance with the disclosure.

Referring now to FIGS. 4A and 7, the blocker rolls 16 are grooved to receive strapping guide channels 20. The strapping guide channels 20 preferably curve upwards along the coil car back as shown in FIG. 4, and then extend above the car back as shown in FIGS. 4 and 6. When the high back coil car is docked at a banding station 30, the extension of strapping guide channels 20 passes just slightly below a strapping guide arm 28 which is part of banding station 30 (see FIG. 6).

Figure 2:
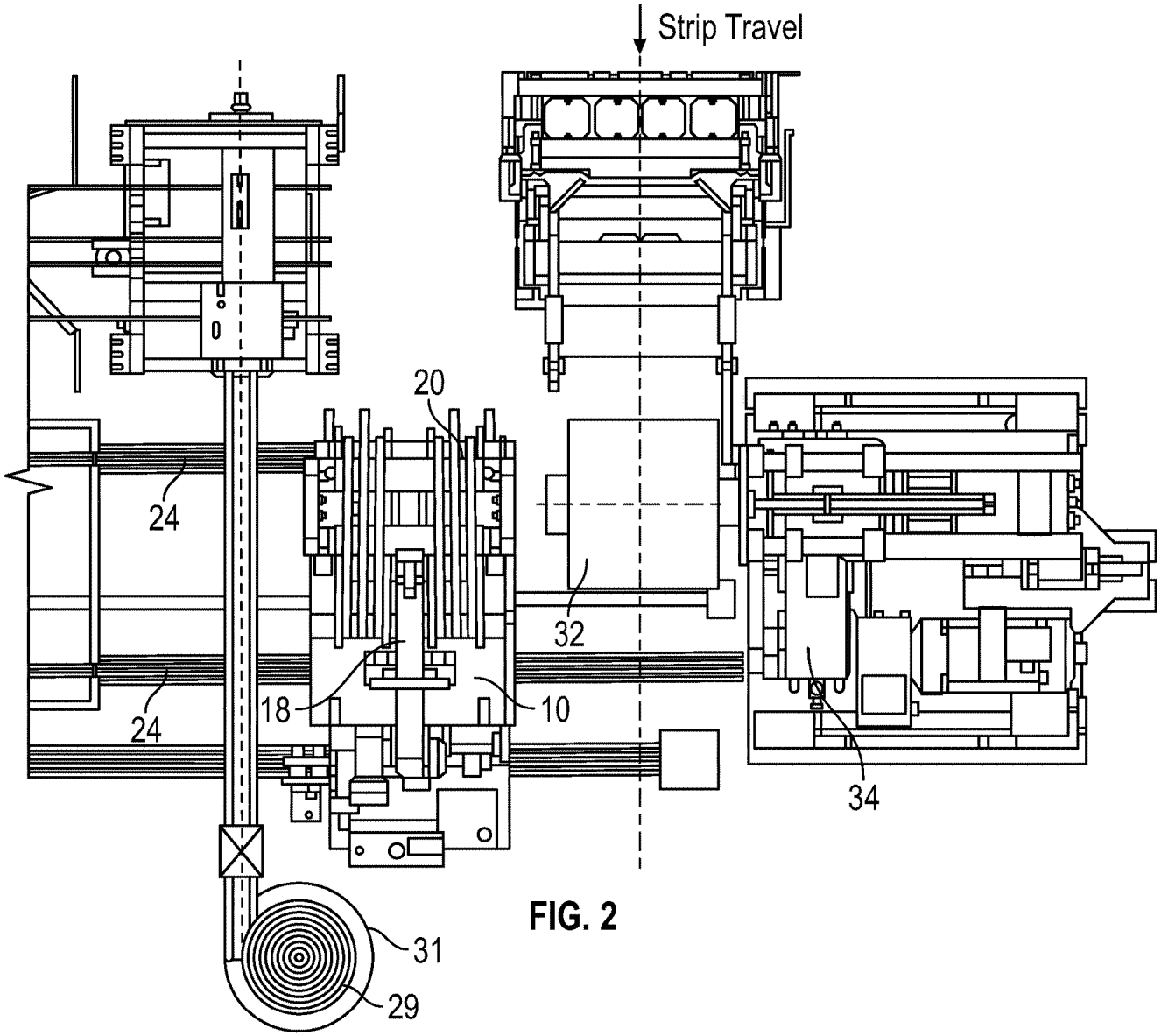
FIG. 2 is a top plan view of a portion of the exit end of the process line of FIG. 1, showing a recoiler, wound coil, a high back coil car, and a banding station in accordance with a preferred embodiment of the disclosure.

Referring also to FIG. 2, during use, a typical sequence would be as follows: Strip is processed and rewound as a coil 32 onto the mandrel of recoiler 34. If the strip has high tensile properties, the strip is wound at high tension. When the strip tails out of the process line, the outer wrap of coil 32 is pinched by a hold down roll 19 (shown in FIG. 3) which is mounted on the recoiler 34.

The high back coil car 10 is then traversed towards coil 32 which is on the mandrel of recoiler 34 (see FIGS. 1-3). At this time, the coil car outer frame 12 is in its fully lowered position. Once in position under coil 32, the coil car outer frame 12 is raised by the hydraulic cylinder 26 until the outer diameter of the coil is tight against blocker rolls 16 (see FIGS. 5 and 4*a*).

At times it may be necessary to rotate the coil 32 on the recoiler 34 mandrel, until the tail of coil 32 is positioned between coil car blocker rolls 16. Blocker rolls 16 are driven via chain and sprockets 26 to facilitate rotation of the coil 32, and to keep the coil 32 outer wrap tight against the coil 32 outside diameter.

The coil car hold down arm 18 is lowered and positioned by a pair of hydraulic cylinders 36 and 38 until the hold down arm pad 40 is in tight engagement against the outside diameter of coil 32.

Recoiler hold down roll 19 is raised via cylinder 41, and the coil car outer frame 12 moves away from the recoiler and is then lowered all the way down. Since coil car hold down arm 18 is mounted to the coil car outer frame 12, coil car hold down arm 18 stays tight against coil 32 while the outer frame 12 is lowered.

The high back coil car 10 now enters an automatic sequence that is initiated by the operator. Specifically, coil car 10 moves away from recoiler 34 advancing towards banding station 30. Coil car 10 traverses via an electric motor with an encoder that is used to position the coil car 10 relative to banding station guide arm 28.

Dependent on the width of coil 32, coil car 10 will position itself such that a coil car strapping guide channel 20 is positioned in complete alignment with a banding slot guide mounted on banding station guide arm 28. Coil car 10 stays in this position until a banding strap 29 (FIGS. 2 and 6) has been applied to the outside diameter of coil 32. To accomplish this, a banding strap is fed from a banding strap roll 31 to banding head 42 then from head 42 upwards and within banding strap arm 28, then down towards and within coil car strapping guide channel 20, which extends down and through coil car blocker rolls 16 (FIG. 4*a*). The leading end of the banding strap continues past the coil car saddle 14, towards the banding head 42 which is then lowered against the outside diameter of coil 32. The banding head 42 pulls the strap tight. The strap 29 comes out of the various strapping guide channels and becomes tight and is cinched against the outside diameter of coil 32. The banding station then clinches or welds the strap end to the body of the strap. The banding head 42 then moves away from the coil 32.

Coil car 10 is then advanced (i.e., indexed) over until the next coil car strapping guide channel 20 is positioned in complete alignment with the banding slot guide mounted on banding station arm 28. The banding sequence recommences and is completed as described above. This operation repeats itself as necessary with coil car 10 indexing as necessary until the full complement of banding straps 29 have been applied to coil 32. The number of straps 29 applied and the number of automatic indexing cycles for coil car 10, is dependent on the width of the coil. In this embodiment, a maximum of six banding straps 29 can be applied. Other numbers of straps are also contemplated by the disclosure.

By the high back car being docked with an automatic loading station, the process line can turn while the banding takes place on the coil car, and keeps the operator safely away from the coil car until the banding is completed.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims and above description.

The invention claimed is:

1. A strip process line comprising:

a high back coil car for automatically banding coil of an associated metal strip on said coil car, wherein said process line runs while banding occurs on said coil car;

wherein said coil car comprises an outer frame and a coil receiving saddle comprising blocker rolls; and a hold down arm and a plurality of strap guide channels;

wherein a first mechanism raises said coil car outer frame and said coil receiving saddle and said blocker rolls.

2. The strip process line of claim 1, wherein said high back coil car is supported on wheels that ride on rails on a floor surface.

3. The strip process line of claim 1, wherein said coil receiving saddle comprises a "V" saddle.

4. The strip process line of claim 1, wherein said blocker rolls are grooved to receive said strap guide channels which pass below a strapping guide arm.

5. The strip process line of claim 4, wherein said metal strip is processed and rewound as said coil onto a recoiler.

6. The strip process line of claim 5, wherein said coil car is moved into position adjacent said coil, and wherein said outer frame is in a fully lowered position.

7. The strip process line of claim 6, wherein said outer frame is raised by said first mechanism until an outer diameter of said coil is tight against said blocker rolls.

8. The strip process line of claim 7, wherein said blocker rolls are driven via a chain and sprockets to facilitate rotation of said coil.

9. The strip process line of claim 8, wherein said coil car hold down arm is raised and lowered by second and third mechanisms until an arm pad is positioned tightly against an outer diameter of said coil.

10. The strip process line of claim 9, wherein when a recoiler has a hold down roll wherein when said recoiler hold down roll is raised, said coil car outer frame moves away from said recoiler and is then lowered.

11. The strip process line of claim 10, wherein said coil car moves away from said recoiler and towards a banding station and is positioned such that one of said strap guide channels is aligned with a banding slot guide on a banding strap arm of said banding station.

12. The strip process line of claim 11, wherein a banding strap of a plurality of banding straps is fed by a banding head upwards and within said banding strap arm and then within said strap guide channel.

13. The strip process line of claim 11, wherein a leading end of the banding strap extends towards said banding head which pulls said strap tight.

14. The strip process line of claim 13, wherein said coil car is advanced until another of said strap guide channels is positioned in alignment with said banding slot guide mounted on said banding station arm.

15. The strip process line of claim 14, wherein said coil car indexes until all of said plurality of banding straps have been applied to said coil.

16. The strip process line of claim 9, wherein said second and third mechanisms comprise hydraulic cylinders.

17. The strip process line of claim 1, wherein said first mechanism comprises a hydraulic cylinder.

18. A method of automatically banding coil of metal strip, comprising:

providing a high back coil car at an end of a process line for automatically banding coil of said associated metal strip on said high back coil car, wherein said process line runs while banding occurs on said high back coil car;

wherein said high back coil car comprises an outer frame, a coil receiving saddle; and a hold down arm and a plurality of strap guide channels; and further providing a first mechanism for raising said coil car outer frame and said coil receiving saddle and blocker rolls.

19. The method of claim 18, wherein said coil receiving saddle comprises a "V" saddle.

20. The method of claim 18, further including moving said coil car into position adjacent said coil, and fully lowering said outer frame in a fully lowered position, and then raising said outer frame via said first mechanism until an outer diameter of said coil is tight against said blocker rolls.

21. The method of claim 20, further including raising and lowering said hold down arm and lowered by second and third mechanisms thereby positioning an arm pad tightly against an outer diameter of said coil.

22. The method of claim 21, further including moving said coil car away from said recoiler and towards a banding station and positioning said coil car such that one of said strap guide channels is aligned with a banding slot guide on a banding strap arm of said banding station.

23. The method of claim 22, further including feeding a banding strap of a plurality of banding straps by a banding head upwards and within said banding strap arm and then within said strap guide channel.

24. The method of claim 23, further including advancing said coil car until another of said strap guide channels is positioned in alignment with said banding slot guide mounted on said banding station arm.

25. The method of claim 21, wherein said second and third mechanisms comprise hydraulic cylinders.

26. The strip process line of claim 18, wherein said first mechanism comprises a hydraulic cylinder.

* * * * *